United States Patent [19]

Coleman

[11] Patent Number: 4,896,882

[45] Date of Patent: Jan. 30, 1990

[54] GOAL-SUPPORTED BASKETBALL RETURN DEVICE

[75] Inventor: Brian L. Coleman, Oxford, Miss.

[73] Assignee: Auburn Research Foundation, Auburn Univ., Auburn, Ala.

[21] Appl. No.: 137,326

[22] Filed: Dec. 23, 1987

[51] Int. Cl.[4] ..... A63B 69/00

[52] U.S. Cl. ..... 273/1.5 A

[58] Field of Search ..... 273/15 A, 395–397

[56] References Cited

U.S. PATENT DOCUMENTS

| | | | |
|---|---|---|---|
| 1,765,269 | 6/1930 | Hatley | 273/1.5 A |
| 2,889,149 | 6/1959 | Williams | 273/1.5 R X |
| 3,233,896 | 2/1966 | King | 273/1.5 A |
| 3,362,712 | 1/1968 | Wagner | 273/1.5 R X |
| 3,799,543 | 3/1974 | Steele, Jr. | 273/1.5 A |
| 3,814,421 | 6/1974 | Spier, Jr. | 273/1.5 A |
| 3,901,506 | 8/1975 | Caveny | 273/1.5 A |
| 3,917,263 | 11/1975 | Wiley | 273/1.5 A |
| 4,244,569 | 1/1981 | Wong | 273/1.5 A |
| 4,291,885 | 9/1981 | Cohen | 273/1.5 A X |
| 4,506,886 | 3/1985 | Lamb, Sr. | 273/1.5 A |
| 4,579,339 | 4/1986 | Grimm | 273/1.5 A |
| 4,579,340 | 4/1986 | Jenkins et al. | 273/1.5 A |
| 4,621,811 | 11/1986 | Campbell | 273/1.5 A |
| 4,706,954 | 11/1987 | Kershaw | 273/1.5 A |

*Primary Examiner*—Paul E. Shapiro

*Attorney, Agent, or Firm*—Banner, Birch, McKie & Beckett

[57] ABSTRACT

An automatic basketball return device designed to allow a basketball to be returned to the player in one or two bounces. The device is portable and may be easily put in place and removed without the need for ladders or tools. The return device is designed to be supported by the rim support bracket, between the backboard and the rim, so that virtually no additional weight is carried by the rim itself. Thus, the natural springiness of the rim is retained and its normal playing characteristics are not altered. A substantially vertical kickplate at the upper end of the device serves to forwardly deflect a basketball passing through the rim in an arched trajectory. The rebound characteristics of the ball off the kickplate depend on the arched trajectory of the ball entering the rim, thereby providing feedback to the player about the type of shot he has made.

25 Claims, 3 Drawing Sheets

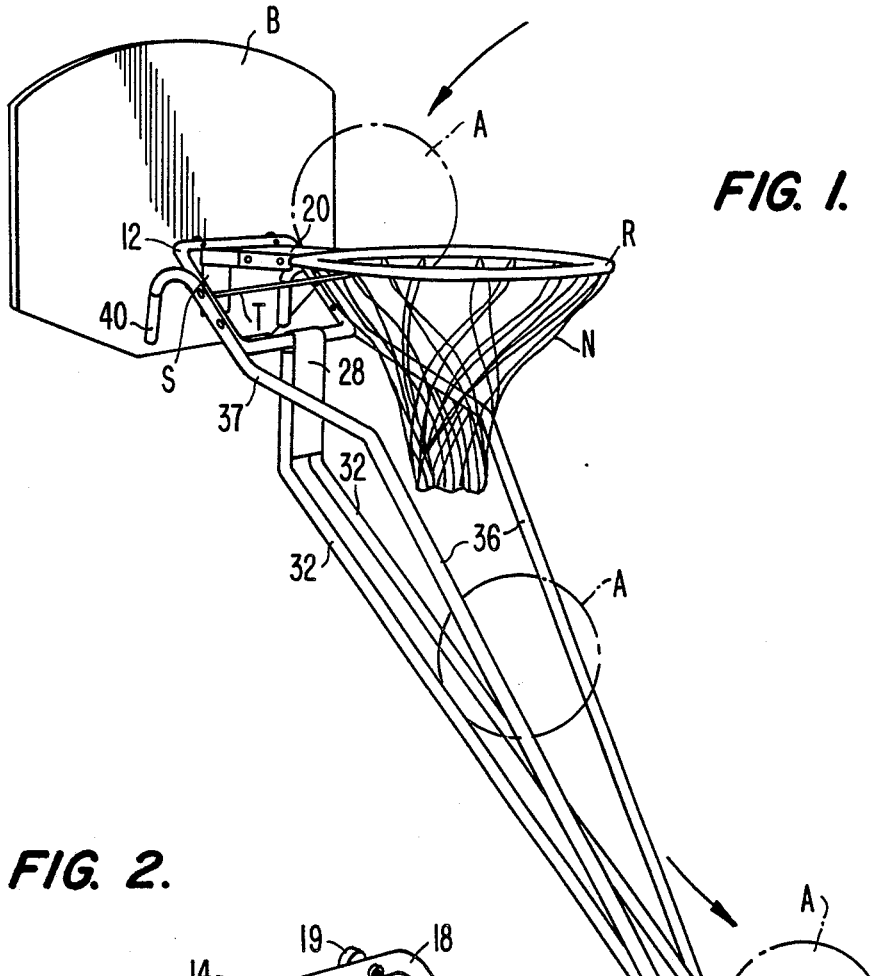
FIG. 1.
FIG. 2.
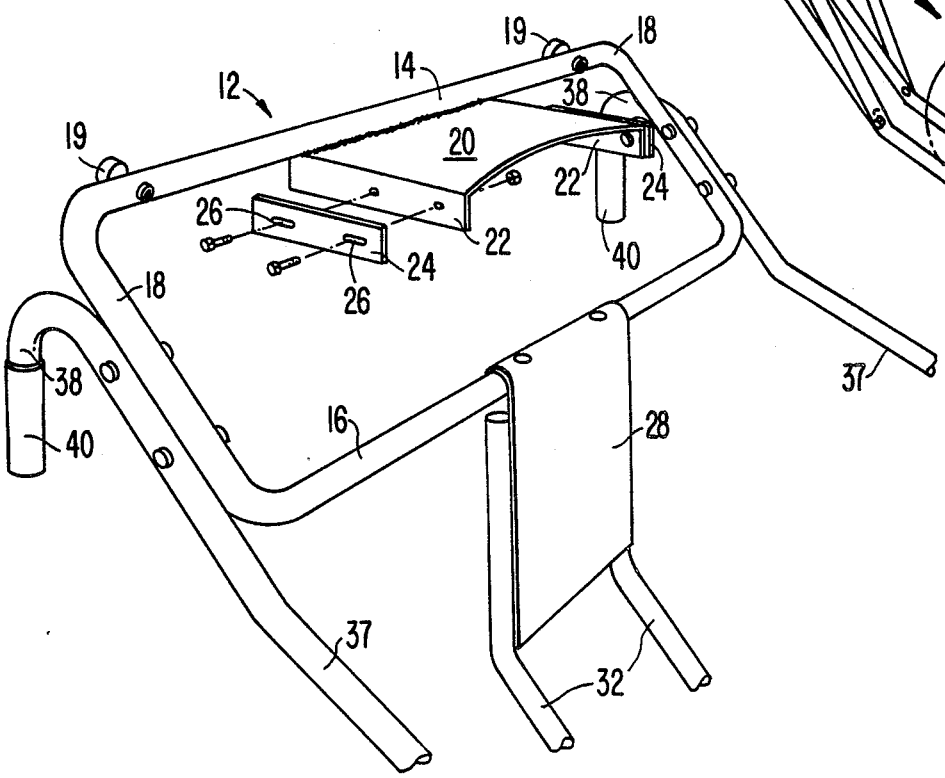

GOAL-SUPPORTED BASKETBALL RETURN DEVICE

BACKGROUND OF THE INVENTION

1. Field of the Invention

This invention relates to a device for use in practicing basketball shooting. The invention provides for the automatic return of a basketball to the player on the court after scoring a "goal," the ball having passed through the circular rim.

2. Description of the Prior Art

The patent to Grimm U.S. Pat. No. 4,579,339 discloses an automatic basketball return device which is attached to and extends downwardly from the rim. The apparatus is attached to the rim by three hooks which extend from the upper end of the apparatus. A centrally located chute returns the ball to the shooter. However, since the device is supported on the rim of the goal and by the rim alone, the weight of the device has a tendency to delfect the rim from its normal horizontal location and alter its natural resiliency.

Similarly, Steele U.S. Pat. No. 3,799,543 teaches an apparatus that is suspended from the rear portion of the rim by three magnets. This device appears lighter than Grimm's and hence the problem of deflection of the rim may not be present; however, a ladder is required to install the apparatus. Steele's ball return deflector comprises a springy metallic flange which extens only to the end of the net and is therefore accurate only to a limited degree in returning the ball to the player's position.

Spier U.S. Pat. No. 3,814,421 discloses a basketball return device in the form of a ring-supported, arcuate plastic chute suspended beneath the rim. The ring may be either attached to the rim by three hooks (as in Grimm) or may extend from the backboard itself. However, when extended from the backboard it apparently must be rather securely installed and thus the use of the basketball goal for ordinary game purposes requires considerable dismantling using a ladder and tools.

Caveney U.S. Pat. No. 3,901,506 and King U.S. Pat. No. 3,233,896 disclose ball return devices comprising net-like chutes extending downwardly from the basketball goal, the lower end of the chute being fastened to the floor of the court. In King, the normal playing characteristics of the basket are distorted because the chute hangs from the rim. In Caveney, the device is hooked to the backboard but is large and unwieldy.

SUMMARY OF THE INVENTION

It is an object of this invention to provide a lightweight, portable basketball return apparatus for practicing basketball shooting which is both easily installed before practice and easily removed after practice, without the need for tools of any kind.

It is a further object of this invention to provide an apparatus which does not alter the normal playing characteristics of the basket rim by causing the rim either to deflect from its normal horizontal playing position or to loose its natural springiness and resiliency.

A further object of the invention is to provide a basketball return device that provides the player with feedback concerning the accuracy and type of trajectory of a basketball thrown through the rim.

These and other objects are accomplished in the present invention by providing a basketball return apparatus comprising chute means for guiding a basketball passing through the rim downwardly and forwardly of the goal, the chute means adapted to underlie the rim and extend forwardly of and obliquely downwardly from the goal to a lower end at a point above the playing surface. Mounting means at the upper end of the chute means is positioned and dimensioned to overlie the rim bracket and fit between the backboard and the rim for removably mounting and supporting the apparatus on the goal. Abutment means at the upper end of the chute means abuts the backboard below the rim bracket and prevents downward pivotal movement of the apparatus about the rim bracket to keep the lower end of the chute means substantially at the point above the playing surface.

The lightweight device may be easily reached and manipulated by a player standing on the playing surface. It is easily slipped off or on the goal, without the need for a ladder or tools. Since the device does not hang from the circular rim, virtually all of the weight of the device is borne by the rim bracket, so that the normal playing characteristics of the rim itself are substantially unaffected.

A further aspect of the invention involves the provision of a substantially vertical kickplate at the upper end of the chute means for forwardly deflecting a basketball passing through the rim in an arched trajectory. The kickplate is located substantially beneath the rearmost edge of the circular opening of the rim.

BRIEF DESCRIPTION OF THE DRAWINGS

The novel features of the invention are set forth with particularity in the appended claims, but the invention will be understood more fully from the following detailed description, taken in conjunction with the accompanying drawings, in which:

FIG. 1 is a perspective view of the basketball return device of the invention in the use position on a basketball goal.

FIG. 2 is a fragmentary, partially exploded view of the device of FIG. 1, showing the elements for attaching the device to the goal.

DESCRIPTION OF THE PREFERRED EMBODIMENT

The basketball return device of the invention largely is composed of hollow, steel tubing. The various pieces are formed in appropriate shapes and bolted or welded together, as described below. The non-tubular portions of the device are formed of steel plate. Paint or any other suitable protective coating is applied for a maintenance-free finish.

Figure 3:
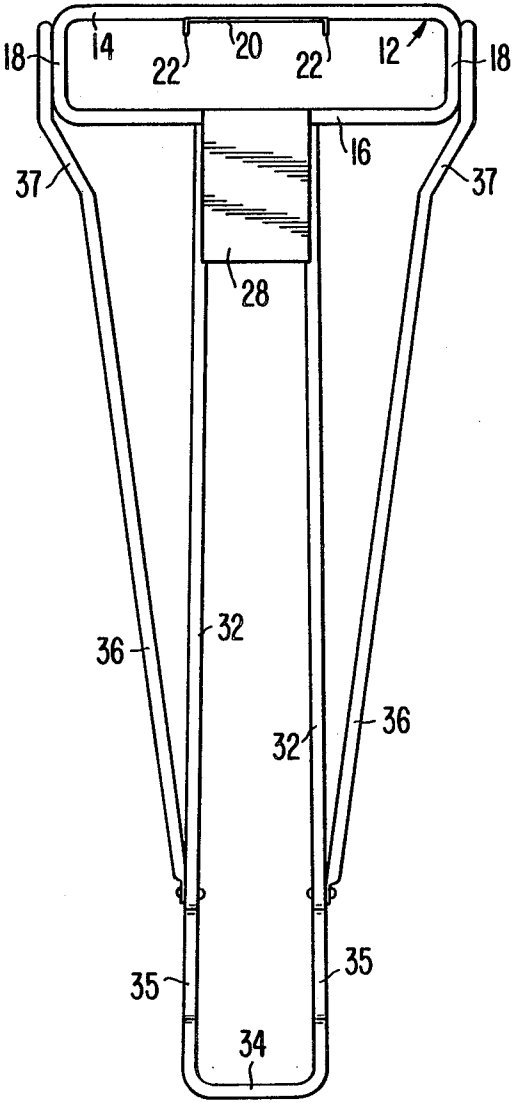
FIG. 3 is a front elevational view of the device of FIG. 1.

Referring to FIGS. 1, 2 and 3, the basketball return device 10 according to the invention comprises a generally rectangular frame 12 having upper and lower parallel portions 14, 16 respectively and side portions 18. Resilient bumpers 19 made of rubber or other suitable material project rearwardly from upper portion 14. Mounting means in the form of a forwardly projecting support bracket 20 is welded to upper portion 14 of frame 12. Bracket 20 is adapted to overlie and rest on the flat, horizontal portion of the L-shaped rim support bracket S (FIG. 1) that is bolted to backboard B and supports basketball hoop or rim R having a net N. In the typical basketball goal arrangement, side reinforcing struts T (FIG. 1) extend from rim support bracket S to rim R for additional support. Support bracket 20 has depending side flanges 22 which are adapted to flank the rim brackets. Adjustable wedge plates 24 having slotted holes 26 are bolted to flanges 22. The purpose of these plates is explained below. With bracket 20 in position on rim support bracket S, bumpers 19 engage backboard B.

A substantially vertical kickplate 28 having a rolled upper end 30 is bolted to the center of lower portion 16 of frame 12. Welded to the back side of kickplate 28 are two rails 32 which extend forwardly and obliquely downwardly away from the goal. Rails 32 are joined at their lower ends by a U-shaped portion 34, and together provide a ramp down which a basketball A can roll. As seen in FIG. 3, the rails gradually diverge from top to the bottom and, of course, are spaced apart along their length a distance less than the diameter of a basketball. As seen in FIG. 1, the lower portions 35 of rails 32 are not as steeply inclined as the upper portions (this to provide a forward "kick" to the ball), while the U-shaped portion 34 drops off more steeply to allow the ball to roll off the ends of the rails 32 unimpeded.

Rails 32 are supprted and maintained in their proper position by a pair of deflector bars 36 which flank the rails and together with the rails define a chute-like structure which receives and guides a basketball passing through the rim R. Support struts 36 are bolted to the rails near their lower ends, while the upper portion of each support strut is bent outwardly to form a deflector bar 37 which is bolted to the side portion 18 of frame 12. The upper end 38 of each support strut 36 is turned vertically downwardly and is covered by a protective plastic sleeve 40. These terminal ends serve as abutment means which contact the backboard B below the rim R and prevent downward pivotal movement of the device about the rim bracket to keep the lower end 34 of the rails substantially at a predetermined point above the playing surface.

Referring to FIGS. 2 and 4, the function of adjustable wedge plates 24 now will be described. One normally encounters some variation in basketball goal construction in the length of the rim bracket S, i.e., the distance between backboard B and rim R. Adjustable wedge plates 24 are designed to tailor the basketball return device ot fit any basketball goal. Accordingly, initial fitting of the device on the goal to be used involves placing the device on the rim bracket S with bumpers 19 contacting backboard B, and moving wedge plates 24 forwardly as far as possible into contact wth rim R so as to minimize the amount of play between the device and the rim. Once this is done, and the wedge plates are firmly tightened against flanges 22 using a wrench, the device can be removed and installed repeatedly on the goal with insurance that it will properly fit and without the need for tools or a ladder. Proper adjustment of wedge plates 24 can also be accomplished without a ladder by trial-and-error adjustment while standing on the playing surface.

Figure 4A:
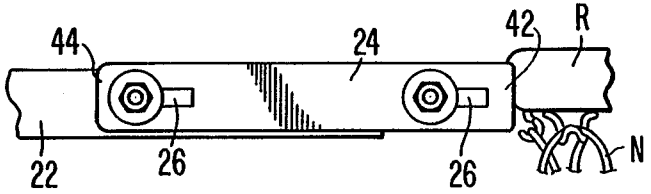
FIGS. 4*a* and 4*b* are detail views of the forwardly extending support bracket shown in FIG. 2.
Figure 4B:
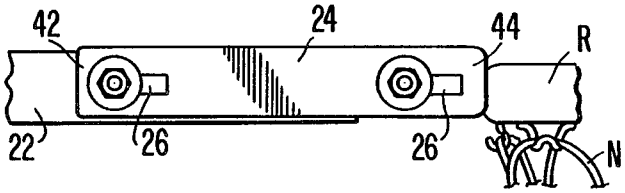

FIGS. 4*a* and 4*b* illustrate a feature of the wedge plates 24 which enables the device to compensate for further variations in goal design. Each wedge plate 24 has a generally squared-off end 42 and a genreally rounded end 44. FIG. 4a illustrates the proper installation of wedge plates 24 on flanges 22 for a basketball goal wherein the rim support bracket (not shown) is welded to or near the bottom of rim R. In that case, the squared-off end 42 provides a better fit. In the situation where the rim support bracket is welded to or near the top side of rim R (FIG. 4b), the wedge plate 24 is reversed for a better fit, with the more rounded end 44 in contact with rim R.

Figure 5:
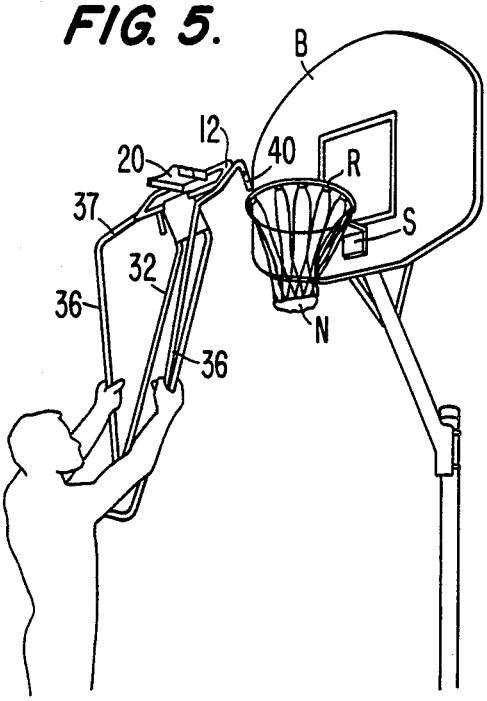
FIG. 5 is a perspective view showing installation of the basketball return device by a user standing on the playing surface.
Figure 6:
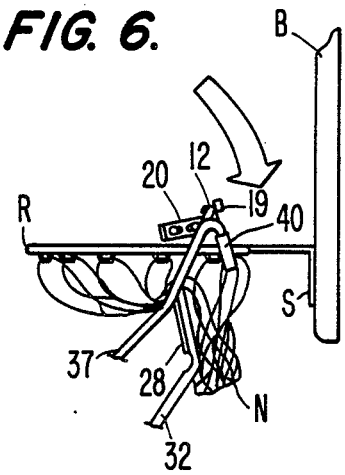
FIG. 6 is a partial side elevational view showing an interim position of the basketball return device during installation on a basketball goal.
Figure 7:
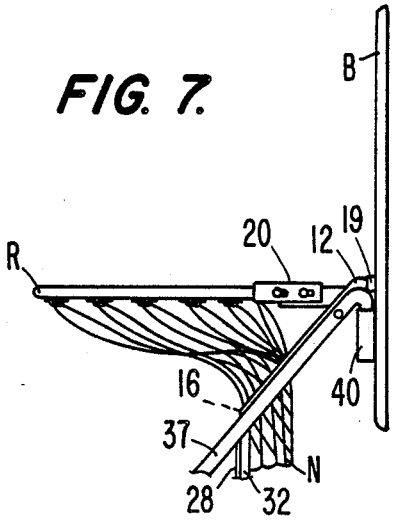
FIG. 7 is a partial side elevational view of the basketball return device just installed on a basketball goal, before a basketball has been thrown through the rim.

In use, the automatic ball return device is placed on the goal by grasping the lower ends of the struts 36 (FIG. 5) and sliding the frame assembly 12 over the rim R (FIG. 6). In other words, the rim and net are "threaded through" frame 12. The bumpers 19 contact the backboard B and the support bracket 20 is then lowered onto the rim support bracket S, with plastic sleeves 40 then abutting backboard B. At this point, the automatic return device is in position for use (FIG. 7). Removeal is accomplished by reversing this procedure. Since the player can reach the struts 36 while standing on the playing surface, a ladder is not required for installation or removal.

As shown in FIG. 7, just after the ball return device is installed on the goal the net N is draped over the lower portion 16 of frame 12. The first ball that passes through the rim and the net will pull the net over portion 16 so that it hangs freely beneath the rim, as illustrated in FIG. 1.

Figure 8:
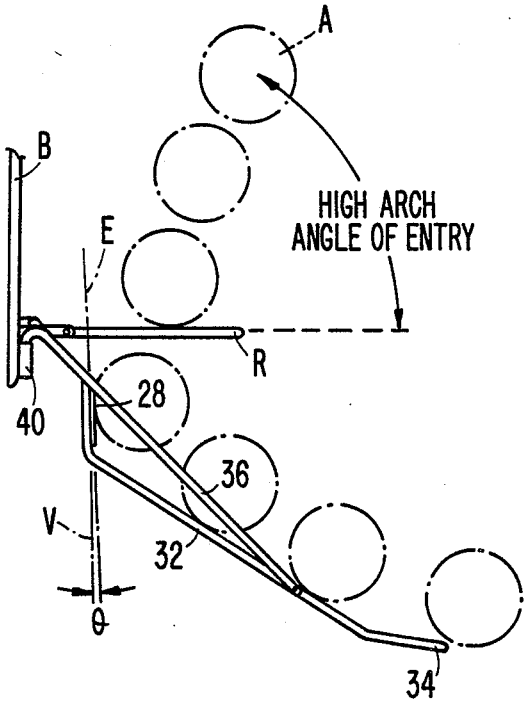
FIG. 8 is a side elevational view of the basketball return device installed on a basketball goal, illustrating the entry and rebound trajectories of a basketball thrown at a high arch angle of entry.
Figure 9:
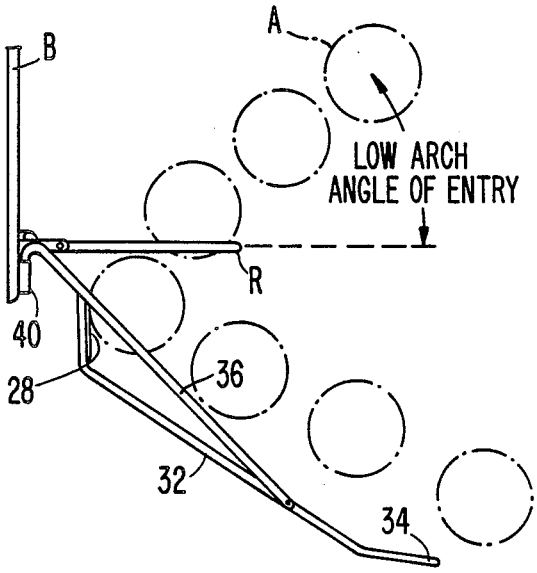
FIG. 9 is a view similar to that of FIG. 8, showing entry and rebound trajectories of a basketball thrown at a low arch angle of entry.

Referring to FIG. 8, the angle and location of kickplate 28 are chosen so as to yield certain rebound characteristics that depend on the arched trajectory of the ball A entering the rim, thereby providing feedback to the player about the type of shot he has made. As illustrated in FIG. 8, the top of kickplate 28 is located approximately just beneath the rearmost edge E of the circular opening of rim R, with the top tilted rearwardly at an angle $\theta$ to the vertical V of approximately zero to five degrees, and preferably three degrees. (A more rearwrad location of kickplate 28 also would be operable, but frame 12 would then have to be foreshortened to raise lower portion 16, possibly causing interference with the reinforcing struts T of some basketball goals during installation of the basketball return device.) When a basketball is shot through the rim R, if the ball is shot with a preferably high arch (FIG. 8), the ball will "swish" through thenet N and rebound off the kickplate. The ball will then roll down the rails 32 and will be centered by the right and left support struts 36. Specifically, the left and right deflector bars 37 assure that the ball will roll down the rails 32 and not be deflected off to the sides. A lower arch shot (FIG. 9) will result in a stronger rebound from the kickplate. In this situation the ball may not roll down the entire length of the rails, but will still be urged by the deflector bars 37 and rails 32 to rebound back to the waiting player at the foul line. In most cases the ball will return to the player in one or two bounces. After the player is finished practicing, the ball return apparatus is simply removed by lifting the device and sliding the frame assembly over the rim.

It will be apparent to those skilled in the art that various modifications may be made without departing from the scope of the invention, which is defined by the appended claims.

I claim:

1. Basketball return apparatus for use with a basketball goal elevated above a playing surface, the goal having a vertical backboard, a horizontal circular rim and rim support means including a rim bracket supporting said rim on the front of said backboard, the apparatus comprising:

chute means for guiding a basketball passing through the rim downwardly and forwardly of the goal, said chute means adapted to underlie the rim and extend forwardly of and obliquely downwardly from the goal to a lower end at a point above the playing surface;

mounting means at the upper end of said chute means positioned and dimensioned to overlie the rim bracket and fit between the backboard and the rim for removably mounting and supporting the apparatus on the goal; and abutment means at the upper end of said chute means for abutting the backboard below the rim bracket and preventing downward pivotal movement of the apparatus about the rim bracket to keep the lower end of said chute means substantially at said point above the playing surface.

2. Apparatus according to claim 1 wherein said chute means comprises a vertical kickplate at the upper end thereof, positioned behind and below the rim, for deflecting a basketball forwardly of the goal.

3. Apparatus according to claim 1 wherein said chute means comprises:

a frame at the upper end thereof attached to said mounting means and adapted to removably engage the backboard;

a pair of inclined rails attached at their upper ends to said frame and extending forwardly of and obliquely downwardly from the goal, beneath the rim, to lower ends at said point above the playing surface, said rails being spaced apart along their length a distance less than the diameter of a basketball; and a pair of support struts above and flanking said rails for supporting said rails and deflecting a basketball onto said rails, said support struts attached to said frame at their upper ends and each support strut attached at its lower end to a lower portion of a respective adjacent rail.

4. Apparatus according to claim 3 wherein said frame is an inclinded rectangular frame sized to pass around the rim, the top of said frame adapted to engage the backboard, the bottom of said frame attached to the upper ends of said rails, and the upper portion of each support strut attached to a respective side of said frame.

5. Apparatus according to claim 4 wherein said chute means further comprises a vertical kickplate at the upper ends of said rails, positioned behind and below the rim, for deflecting a basketball forwardly of the goal.

6. Apparatus according to claim 5 wherein the lower ends of said rails are interconnected.

7. Apparatus according to claim 6 wherein the lower ends of said rails terminate in a U-shape.

8. Apparatus according to claim 3 wherein said abutment means are located at the sides of said frame.

9. Apparatus according to claim 8 wherein said abutment means comprises downturned vertical upper ends of said support struts.

10. Apparatus according to claim 9 wherein said frame is an inclined rectangular frame sized to pass around the rim, the top of said frame adapted to engage the backboard, the bottom of said frame attached to the upper ends of said rails, and the upper portion of each support strut attached to a respective side of said frame.

11. Apparatus according to claim 10 wherein said chute means further comprises a vertical kickplate at the upper ends of said rails, positioned behind and below the rim, for deflecting a basketball forwardly of the goal.

12. Apparatus according to claim 3 wherein said mounting means comprises a flat horizontal bracket attached to said frame and having depending side flanges adapted to flank the rim bracket.

13. Apparatus according to claim 12 wherein said mounting means further comprises an adjustable wedge plate slidably and adjustably secured to each of said side flanges to contact the rim when said frame engages the backboard, thereby wedging said mounting means between the backboard and the rim.

14. Apparatus according to claim 12 wherein said abutment means are located at the sides of said frame.

15. Apparatus according to claim 14 wherein said abutment means comprises downturned vertical upper ends of said support struts.

16. Apparatus according to claim 15 wherein said frame is an inclined rectangular frame sized to pass around the rim, said horizontal bracket attached to the top of said frame and the top of said frame adapted to engage the backboard, the bottom of said frame attached to the upper ends of said rails, and the upper portion of each support strut attached to a respective side of said frame.

17. Apparatus according to claim 16 wherein said chute means further comprises a vertical kickplate at the upper ends of said rails, positioned behind and below the rim, for deflecting a basketball forwardly of the goal.

18. A combination of a basketball return apparatus and a basketball goal elevated above a playing surface, said goal having a vertical backboard, a horizontal circular rim and rim support means including a rim bracket supporting said rim on the front of said backboard, said basketball return apparatus comprising:

a frame at the upper end thereof removably engaging said backboard;

a pair of inclined rails attached at their upper ends to said frame and extending forwardly of and obliquely downwardly from said goal, beneath said rim, to lower ends at a point above the playing surface, said rails being spaced apart along their length a distance less than the diameter of a basketball and interconnected at their lower ends;

a pair of support struts above and flanking said rails for supporting said rails and deflecting a basketball onto said rails, said support struts attached to said frame at their upper ends and each support strut attached at its lower end to a lower portion of a respective adjacnet rail;

a vertical kickplate at the upper ends of said rails, positioned behind and below said rim, for deflecting a basketball forwardly of said goal;

a flat horizontal bracket centrally attached to said frame and overlying said rim bracket, said flat horizontal bracket fitting between said backboard and said rim and having side flanges flanking said rim bracket; and a pair of abutments attached to said frame on opposite sides of and below said horizontal bracket and abutting said backboard and preventing downward pivotal movement of said apparatus about said rim bracket to keep the lower ends of said rails substantially at the point above the playing surface.

19. Apparatus according to claim 18 wherein said abutments comprise downturned vertical upper ends of said support struts.

20. Apparatus according to claim 19 wherein said frame is an inclined rectangular frame sized to pass around the rim, the top of said frame adapted to engage the backboard, the bottom of said frame attached to the upper ends of said rails, and the upper portion of each support strut attached to a respective side of said frame.

21. A basketball return apparatus for use with a basketball goal elevated above a playing surface, the goal having a vertical backboard, a horizontal circular rim and rim support means including a rim bracket supporting the rim on the front of the backboard, said apparatus comprising:

chute means for guiding a basketball passing through the rim downwardly and forwardly of the goal, said chute means adapted to underlie the rim and extend forwardly of and obliquely downwardly from the goal to a lower end at a point above the playing surface;

mounting means at the upper end of said chute means for removably mounting and supporting said apparatus on the goal, said mounting means adapted to overlie the rim bracket to support said apparatus; and a kickplate discrete from and attached to said chute means at the upper end of said chute means for forwardly deflecting a basketball passing through the rim in an arched trajectory, said kickplate adapted to be located substantially beneath the rearmost edge of the circular opening of the rim.

22. Apparauts according to claim 21 wherein said kickplate is disposed at an angle to the vertical in the range of zero to five degrees, with the top of said kickplate tilted rearwardly.

23. Apparatus according to claim 22 wherein the angle of inclination of said kickplate is three degrees.

24. Apparatus according to claim 22 wherein said kickplate is vertical.

25. A basketball return apparatus for use with a basketball goal elevated above a playing surface, the goal having a vertical backboard, a horizontal circular rim and rim support means including a rim bracket supporting the rim on the front of the backboard, said basketball return apparatus comprising:

a frame at the upper end of said apparatus adapted to removably engage the backboard;

a pair of inclined rails attached at their upper ends to said frame and disposed to extend forwardly of and obliquely downwardly from the goal and beneath the rim, to lower ends at a point above the playing surface, said rails being spaced apart along their length a distance less than the diameter of a basketball and interconnected at their lower ends;

a pair of support struts above and flanking said rails for supporting said rails and deflecting a basketball onto said rails, said support struts attached to said frame at their upper ends and each support strut attached at its lower end to a lower portion of a respective adjacent rail;

a vertical kickplate at the upper ends of said rails and disposed so as to be positioned behind and below the rim, for deflecting a basketball forwardly of the goal;

a flat horizontal bracket centrally attached to said frame and adapted to overlie the rim bracket and fit between the backboard and the rim, and having side flanges adapted to flank the rim bracket; and a pair of abutments attached to said frame on opposite sides of and below said flat horizontal bracket and adpated to abut the backboard and preventing downward pivotal movement of said apparatus about the rim bracket to keep the lower ends of said rails substantially at the point above the playing surface.

* * * * *